US007895737B2

(12) United States Patent
Roth et al.

(10) Patent No.: US 7,895,737 B2
(45) Date of Patent: Mar. 1, 2011

(54) WINDING MACHINE FOR WINDING SOLENOID SHAPED COILS HAVING BAND-SHAPED CONDUCTORS

(75) Inventors: Gerhard Roth, Rheinstetten (DE); Klaus Schlenga, Linkenheim (DE); Thorsten Greeb, Karlsruhe (DE); Roland Binger, Hemer (DE)

(73) Assignee: Bruker Biospin GmbH, Rheinstetten (DE)

( * ) Notice: Subject to any disclaimer, the term of this patent is extended or adjusted under 35 U.S.C. 154(b) by 901 days.

(21) Appl. No.: 11/714,179

(22) Filed: Mar. 6, 2007

(65) Prior Publication Data

US 2007/0266552 A1 Nov. 22, 2007

(30) Foreign Application Priority Data

Apr. 6, 2006 (DE) ..... 10 2006 016 169

(51) Int. Cl.
*H01R 43/033* (2006.01)

(52) U.S. Cl. ..... 29/748; 29/745; 29/605; 242/443; 242/439

(58) Field of Classification Search ..... 29/605, 29/606, 745, 748; 242/443, 444, 439
See application file for complete search history.

(56) References Cited

U.S. PATENT DOCUMENTS 3,801,029 A * 4/1974 Malburg ..... 29/605
4,870,742 A 10/1989 Roloff
5,921,487 A 7/1999 Junius
6,049,966 A 4/2000 Kawano et al.

FOREIGN PATENT DOCUMENTS

JP 58-135067 8/1983
JP 01135010 A * 5/1989

* cited by examiner

*Primary Examiner*—A. Dexter Tugbang
(74) *Attorney, Agent, or Firm*—Paul Vincent

(57) ABSTRACT

A winding machine (1) for winding solenoid-shaped coils (21) with band-shaped conductors (6), comprising a winding means (3) which holds a circular-cylindrical coil core (2) of a coil (21) to be wound, and a winding drive which rotates a coil core (2), which is held in the winding means (3), about a winding axis W, wherein the winding means (3) can be moved in a first direction A by an axial drive, the direction A preferably extending approximately parallel to the winding axis W, is characterized in that the winding means (3) can be rotated about a pivot axis S by a pivot drive, wherein the pivot axis S extends perpendicularly to the direction A. The winding machine winds a solenoid-shaped coil with several layers of a band-shaped conductor without damaging the band-shaped conductor, in particular, when the band-shaped conductor contains brittle superconducting material.

16 Claims, 6 Drawing Sheets

WINDING MACHINE FOR WINDING SOLENOID SHAPED COILS HAVING BAND-SHAPED CONDUCTORS

This application claims Paris Convention priority of DE 10 2006 016 169.6 filed Apr. 6, 2006 the complete disclosure of which is hereby incorporated by reference.

BACKGROUND OF THE INVENTION

The invention concerns a winding machine for winding solenoid-shaped coils having band-shaped conductors, comprising a winding means that can hold a circular cylindrical coil core of a coil to be wound, and a winding drive that can turn a coil core, held in the winding means, about a winding axis W, wherein the winding means can be moved in a first direction A using an axial drive, the direction A preferably extending approximately parallel to the winding axis W.

U.S. Pat. No. 4,870,742 discloses a winding machine of this type.

Solenoid-shaped coils are used to generate strong magnetic fields which are required e.g. in nuclear magnetic resonance (NMR) spectroscopy or magnetic resonance imaging (MRI). A conductor is wound on them, with several layers of conductors being disposed on top of each other. The individual layer is helically wound.

Conductors containing superconducting material are used to increase the magnetic field strength. The use of HTS materials (high-temperature superconducting materials) is thereby particularly desired, since these can carry a higher current than conventional superconductor materials under certain temperature and magnetic field conditions of use. The typical design of high-temperature superconductors is a band shape. Band-shaped conductors have an approximately rectangular cross-section, with a first side (long side) being considerably longer than a second side (short side). Typical side-width ratios are 10:1 and more. In case of high-temperature superconductors containing bismuth, the superconducting material is thereby typically present in the form of filaments which are surrounded by a silver matrix.

Many superconducting materials, in particular HTS materials, break easily under mechanical load, in particular during winding of a coil. When an excessive number of superconducting filaments in a band-shaped conductor break, the conductor becomes useless, since the current carrying capacity that can be technically utilized decreases. Bending through the short side is particularly detrimental for band-shaped conductors with brittle superconducting material.

U.S. Pat. No. 4,870,742 describes winding a solenoid-shaped coil with band-shaped conductors by guiding a band-shaped conductor to a rotating coil core using stationary guiding means. The coil core is axially carried along in one layer in correspondence with the winding advance. This prevents bending of the conductor through the short side due to winding advance in the layer.

The winding machine in accordance with U.S. Pat. No. 4,870,742 is well suited to produce a solenoid-shaped coil with only one layer. However, for magnet coils, several continuously connected layers are desirable. For changing from one finished layer to a further overlying layer, the pitch of the helical winding must be reversed. The changed pitch strongly bends the band-shaped conductor through the short side and the conductor is in danger of being damaged.

In contrast thereto, it is the object of the present invention to provide a winding machine for winding a solenoid-shaped coil with several layers of band-shaped conductor without damaging the band-shaped conductor, in particular, when the band-shaped conductor contains brittle, superconducting material.

SUMMARY OF THE INVENTION

This object is achieved by a winding machine of the above-mentioned type, which is characterized in that the winding means can be rotated by a pivot drive about a pivot axis S, wherein the pivot axis S extends perpendicularly to the direction A.

Since the winding means can be pivoted, the intake angle of the band-shaped conductor can be adjusted during change from one finished layer to another overlying layer. The band-shaped conductor is supplied to the coil at a substantially fixed direction B. The intake angle is the relative angle between the direction B and the circumferential direction of the coil at the contact point between the supplied band-shaped conductor and the coil. When the intake angle corresponds to the pitch angle of the helix of the actual layer, the supplied band-shaped conductor is not bent at all. The pitch angle of the helix is the relative angle between the direction of extension of the wound, band-shaped conductor and the local peripheral direction of the coil. In a transition between a finished layer and the layer above it, the pitch angle is typically approximately reversed (i.e. it changes sign). If bending of the band-shaped conductor over the short side shall be prevented during and after layer change, the intake angle must also be adjusted. In accordance with the invention, this adjustment of the intake angle is possible, since the winding means can be pivoted about the pivot axis S. Pivoting of the winding means also pivots the winding axis W, whereby the intake angle can be adjusted when the supply direction B is fixed. Geometry dictates that the intake angle is equal to the pivot angle.

In one particularly preferred embodiment of the inventive winding machine, the winding means can be moved by a translation drive in a second direction T, wherein the direction T extends perpendicularly to the direction A and parallel to the pivot axis S. The mobility in the direction T prevents bending of the conductor in the area of stationary guiding means, e.g. guiding rollers, upstream of the winding means in that the winding means is moved in correspondence with the diameter of the coil, which increases with progressive winding.

In another embodiment of the inventive winding machine, the winding means can be rotated about an additional pivot axis Z using an additional pivot drive, wherein the additional pivot axis Z extends parallel to a direction B, the winding machine being designed to supply the band-shaped conductor to the coil in the B direction. The additional pivot drive is used mainly in case the band conductor tilts e.g. in consequence of the torque during winding with an insulation material. Alternatively, the additional pivot axis Z may also extend perpendicularly to the direction A and perpendicularly to the pivot axis S.

In a preferred embodiment, the winding machine has at least one unwinding means that can hold a supply coil for band-shaped conductors, wherein the supply coil is preferably designed as a flat coil. The supply coil and the unwinding means provide the band-shaped conductor to be wound. Flat coils that contain only one winding per layer, need not be axially adjusted during unwinding and are therefore easy to handle.

In a preferred further development of this embodiment, guiding means, in particular guiding rails, are provided for transferring the band-shaped conductor from the supply coil of the at least one unwinding means to the coil core of the winding means. The orientation of the band-shaped conductor can be determined during rewinding using the guiding means, in particular, to prevent undesired bending.

In one particularly preferred further development of this design, the guiding means are stationary relative to the winding machine, and the guiding means are designed in such a fashion that a band-shaped conductor to be transferred, is not or only slightly bent through the short side in the area from, and including, the supply coil to, and including, the guiding means, wherein the radius of curvature of the band-shaped conductor over the short side on the outer side of the band-shaped conductor is preferably always larger or equal to 1 m, and preferably larger or equal to 5 m. Stationary guiding means facilitate machine construction. The guiding means may guide the band-shaped conductor in a tight and rigid fashion to prevent detrimental bending.

In another preferred further development, the guiding means and/or the unwinding means have a conductor drive for supplying the band-shaped conductor from the supply coil of the at least one unwinding means via the guiding means to the winding means, and the conductor drive can be operated independently of the winding drive. The conductor drive can limit the mechanical stress acting on the band-shaped conductor during rewinding. Independent actuation facilitates threading the band-shaped conductor into the guiding means and onto the coil core.

It is thereby particularly preferred for the conductor drive to comprise a crawler drive. The crawler drive has proven itself in practice.

In a particularly preferred embodiment, a control means is provided which automatically adjusts the layer of the winding means in view of the pivot angle $\alpha$ of the pivot axis S and/or the position in direction A and/or the position in direction T and/or the angle of rotation of the additional pivot axis Z during coil winding, such that a band-shaped conductor to be transferred to the coil core is not or only marginally bent through the short side, in particular, in an area from, and including, the guiding means to, and including, the coil core, in particular, wherein the radius of curvature of the band-shaped conductor through the short side on the outer side of the band-shaped conductor is always larger or equal to 1 m and preferably larger or equal to 5 m. The control means, e.g. a computer, provides automated layer adjustment of the winding means, in particular, during turning. This renders operation of the winding machine more efficient.

Another preferred embodiment is characterized by several unwinding means and guiding means for stacking several band conductors from several unwinding means and guiding them together to the winding means. One strand of stacked band conductors is thereby wound in one layer. This embodiment also permits winding of coils permitting operating currents above the current carrying capacity of one single band.

In another advantageous further development, each single unwinding means has one tensile force control that can be individually regulated. The mechanical load on each individual band-shaped conductor of one strand can thereby be controlled and defined to avoid damage to the band conductor.

In an advantageous embodiment, an insulation station is provided for winding an insulation material about a band conductor and/or stacked band conductors. The insulation clearly defines the electric current paths.

The current flows parallel in one stack of band conductors, and the insulation station commonly insulates such a stack from the neighboring layers and neighboring windings.

In a further development, the insulation station is mounted for rotation about an axis D which extends perpendicularly to the direction of motion F of the band conductor or the stack of band conductors. This also realizes highly uniform winding of a band-shaped insulation material. The angle $\delta$ between the insulation material and the band conductor or stack can then be adjusted to ensure maximum uniform winding of the band conductor of the stack.

In one preferred embodiment of the inventive winding machine, the winding machine is designed such that all winding functions may be performed in reverse order by pressing a button. This facilitates elimination of errors.

In another particularly preferred embodiment, an intake measuring means is provided for monitoring the conductor intake using contact-less distance measurement. Conductor intake designates the position and orientation (e.g. inclination) of the supplied band-shaped conductor shortly upstream of the winding means, in particular between the last guiding means in the running direction, and the coil. The intake measuring means data can be used to control the position of the winding means.

In another preferred embodiment, the winding machine is designed such that the axial drive can be separately stopped.

In a particularly preferred embodiment, the axial drive can move the winding means together with the pivot drive, wherein a stationary rail is preferably provided along which an axial carriage may be moved by the axial drive, the winding means including pivot drive being mounted to the axial carriage. This structure is particularly robust. In this embodiment, the winding axis W is not exactly parallel to the direction A. This deviation corresponds to the pivot angle.

In an alternative and also particularly preferred embodiment, the pivot drive may pivot the winding means including the axial drive, wherein a rail is preferably provided which can be pivoted using the pivot drive, along which the winding means can be moved by the axial drive. In this embodiment, the band-shaped conductor or stack of band conductors always meets the coil at the same spatial location. This improves control of the winding process. In this embodiment, the winding axis W is always parallel to the direction A.

The invention also concerns a method for winding a solenoid-shaped coil with a band-shaped conductor, wherein the band-shaped conductor is wound onto the coil having a circular-cylindrical coil core, with a winding axis W, wherein the band-shaped conductor is supplied in a direction B to the coil and meets the coil in a tangential plane E, characterized in that several layers of band-shaped conductors are wound onto the coil and the winding axis W has a time-variant pivot angle $\alpha$ about a pivot axis S relative to a direction OB, wherein the direction OB extends within the tangential plane E and perpendicularly to the direction B, and wherein the pivot axis S extends perpendicularly to the tangential plane E, the pivot angle $\alpha$ being adjusted such that it corresponds to the pitch angle $\beta$ of the windings of the band-shaped conductor on the coil relative to the winding axis W at all times during winding of the coil.

The pitch angle $\beta$ is thereby substantially a function of the conductor width and the actual coil diameter. The windings of one layer are usually tightly arranged. The pivot angle $\alpha$ (and thereby the intake angle) must be adjusted when changing from one finished layer to an overlying layer. The inventive method prevents bending of the band-shaped conductor (or of a stack of band conductors that may be used, in accordance with the invention, instead of one single band conductor) through the short side to prevent the band-shaped conductor from being damaged. The finished coil is then wound with an intact band-shaped conductor. In accordance with the inventive method, the coil core is typically moved in accordance with the winding progression in a direction A, wherein the direction A extends perpendicularly to the pivot axis S and approximately parallel to the winding axis W. The direction A may, in particular, extend parallel to the direction OB or parallel to the winding axis W.

In a preferred variant of the inventive method, direction B and the tangential plane E are constant during winding of the coil. This facilitates handling of the band-shaped conductor and prevents it from being damaged.

In another preferred variant, the coil core is automatically moved by the height HL of the band conductor in a direction T during a layer change, wherein the direction T extends parallel to the pivot axis S. The conductor intake can thereby be maintained even during a layer change. If the band conductor has insulation, the height HL of the band conductor includes this insulation. If a stack of band-shaped conductors is wound, the height HS of the stack is automatically moved, wherein this height HS also includes any insulation.

In a further preferred variant, the coil core is moved transversely in the direction OB during winding of the coil, wherein one turning of the coil involves a travelling distance of one conductor width BR. This ensures that the windings of one layer of the wound coil are tightly arranged. The coil is then mechanically robust and suited for generating large magnetic fields. If an insulation is provided, the conductor width includes the insulation.

In another alternative preferred method variant, the coil core is moved transversely in the direction of the winding axis W during winding of the coil, wherein one turning of the coil involves a displacement of $BR/\cos(\beta)$. This also ensures that the windings of one layer of the wound coil are tightly arranged. When an insulation is provided, the conductor width also includes this insulation.

In another preferred variant of the inventive method, wherein a layer change of the coil includes a turning manoeuvre, the pivot angle $\alpha$ is automatically changed by the sum of the amounts of the pitch angle $\beta$ of the just finished layer and the pitch angle $\beta$ of the next layer to be wound. This turning manoeuvre can be easily applied for a common winding with uniform pitch distribution. Winding of the next layer may be started directly after turning.

In a preferred further development of this embodiment, the pivot angle $\alpha$ is approximately uniformly changed through at least a quarter turning of the coil about the winding axis W, preferably through at least one full turning of the coil about the winding axis W. This reduces or limits dangerous torsion of the band conductor (or of a band conductor stack) during layer transfer.

In one method variant which is preferred in this connection, the above-described rotatable insulation station is used, wherein an insulating tape is wound as insulation about the band conductor so that it partially overlaps, wherein the angle of rotation $\delta$ of the insulation station is set in accordance with the condition $\arctan(\delta)=(\text{insulating tape width}-\text{overlap width})/[2*(HL+BR)]$. A band-shaped insulation material may thereby be wound in a very uniform fashion.

In another preferred method variant, several band-shaped conductors are stacked to one conductor strand and the conductor strand of band-shaped conductors is wound onto the coil, wherein the height HS of the conductor strand replaces, in each case, the height HL of the band-shaped conductor. This also permits production of coils having a higher current-carrying capacity.

In one method variant, the method may advantageously be performed with an inventive winding machine as described above.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

The invention is shown in the drawing and is explained in more detail with reference to embodiments.

DESCRIPTION OF THE PREFERRED EMBODIMENT

Figure 1:
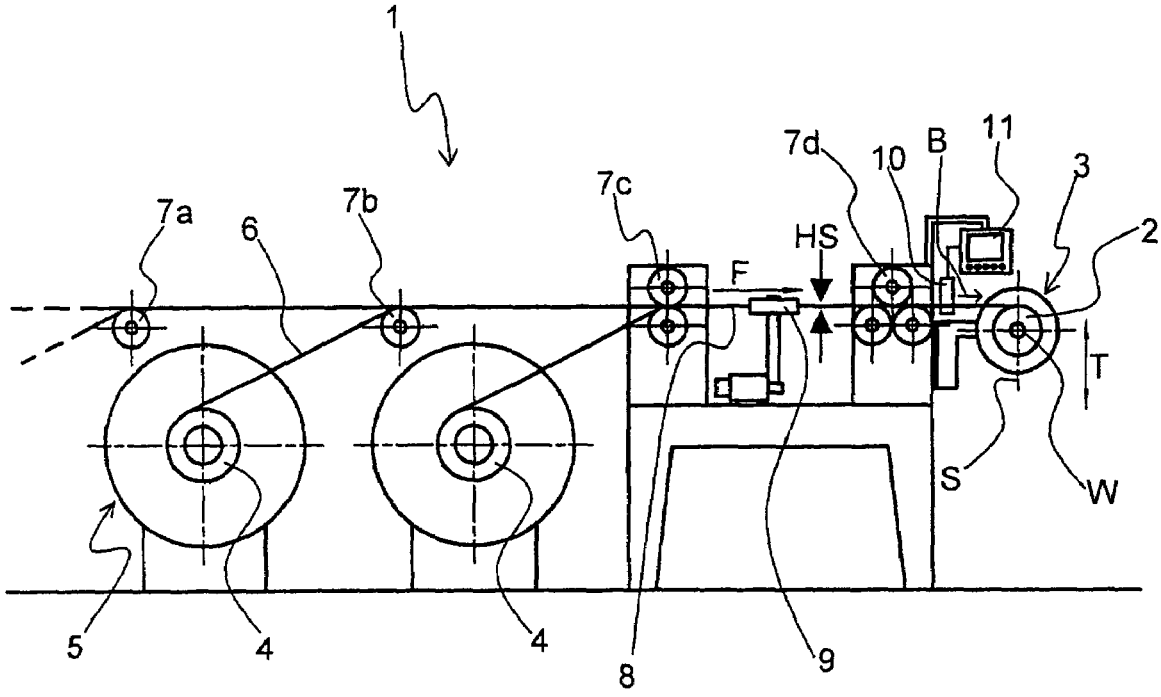
FIG. 1 shows a schematic side view of an embodiment of an inventive winding machine.

FIG. 1 shows a schematic side view of an embodiment of an inventive winding machine 1. A coil core 2 is held in a winding means 3. The winding means 3 has a winding drive (not shown) for turning the coil core 2 about a winding axis W. The winding axis W extends approximately perpendicularly to the plane of the drawing.

The winding machine 1 has several supply coils 4 for band-shaped conductors 6. The supply coils 4 are designed as flat coils. The flat coils have only one winding per layer, similar to a sound recording tape. The supply coils 4 are disposed in unwinding means 5 which turn the supply coils 4 via a motor to unwind the band-shaped conductor (band conductor) 6. The band-shaped conductors 6 advantageously comprise superconducting material, in particular, brittle HTS material. The band-shaped conductors 6 are combined into a conductor strand or conductor stack 8 of band-shaped conductors 6 using guiding means 7*a*-7*d*, in the present case guiding rollers, and guided to the winding means 3 or the coil core 2. The conductor strand 8 is thereby wound onto the coil core 2, thereby producing a coil.

After combination of all band-shaped conductors 6 into a conductor strand 8 at the guiding means 7*c*, the conductor strand 8 is supplied to an insulation station 9, in which the conductor strand 8 is wound with an insulation material, e.g. a band-shaped plastic foil, approximately perpendicularly ($\delta$=90°) to the local direction of movement F. The insulation station can be turned about an axis of rotation D perpendicularly to the direction of motion F, such that the insulation material is ideally applied at an angle 6, wherein arctan $\delta$=(insulating tape width overlap width)/(2*HS+2*BR). The overlapping area may thereby be adjusted via the relationship between the speed of the conductor in the direction of movement F and the winding speed. The axis D extends e.g. in a vertical direction.

The conductor strand 8 passes through an intake measuring means 10, disposed between the last guiding means 7*d* and the coil core 2 or the partially wound coil, which measures the position of the strand 8 using optical sensors. The position of the strand 8 depends on the stationary guiding means 7*d* and the contact location or the contact line of the strand 8 on the coil core 2 or the partially wound coil. The contact location depends, in turn, on the position of the winding means 3. In an optimum position, the strand 8 extends in a rectilinear fashion behind the guiding means 7*d* as a continuation of the direction of movement F between the guiding means 7*c* and 7*d*. When the intake measuring means 10 determines a deviation from this optimum position (e.g. relative to the absolute position, or tilting), an electronic control means 11 instructs change in the position of the winding means 3, which also corrects the position of the strand 8 during further winding.

The winding means 3 can be pivoted about a perpendicular pivot axis S via a pivot drive (not shown). The winding means 3 can moreover be displaced by an axial drive (not shown) in a direction A which extends approximately perpendicularly to the plane of the drawing in the present case. These different possibilities of movement of the winding means 3 are shown very clearly in the following FIGS. 2*a* to 2*h*. The winding means 3 may finally also be vertically displaced in the direction T using a translation drive (not shown). When one winding layer has been completed, the winding means 3 (and thereby also the partially wound coil) is lowered by the height HS of one conductor strand 8, such that the strand 8 is also horizontally supplied to the coil in the next layer. The height HS of the conductor strand 8 is thereby the sum of the thicknesses of the stacked band-shaped conductors 6 and the thicknesses of the upper and lower insulation of the stack (compare FIG. 7*b*).

FIGS. 2*a*-2*d* and 2*e*-2*h* show different views of embodiments of inventive winding machines 1 which differ only in view of type of motion of the winding means 3 (or coil 21). The schematic side view does not show the differences. For this reason there is only one side view of FIG. 1 for the two embodiments of FIGS. 2*a*-2*d* and 2*e*-2*h*.

Figure 2A:
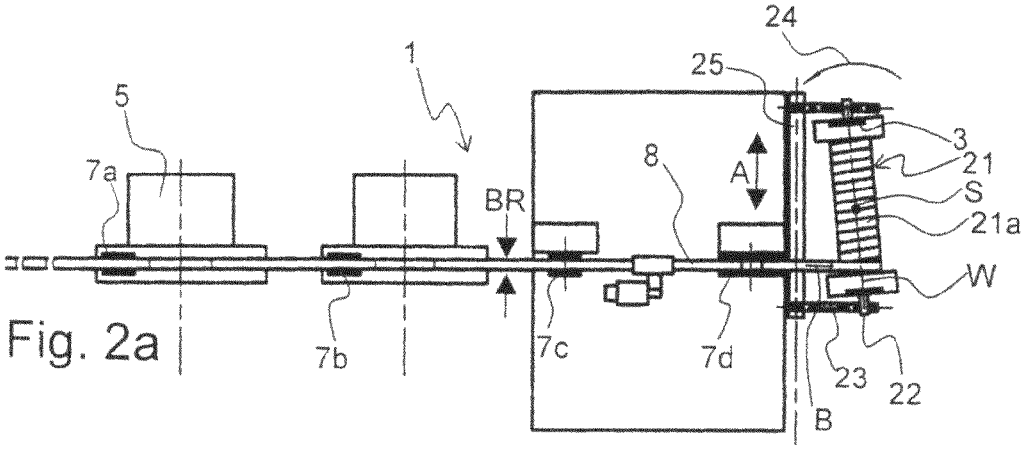
FIG. 2*a* shows a schematic view of an embodiment of an inventive winding machine, wherein the winding means and the pivoting means are disposed on an axial carriage.

The embodiment of FIG. 2*a* shows a coil 21, wherein winding of a new layer has just started. The coil 21 comprises the coil core onto which the conductor strand 8 has been wound with numerous windings 21*a*. The coil 21 is held by a winding means 3. A winding drive (not shown) is integrated in the winding means 3, for turning the coil 21 about its central axis, i.e. the winding axis W.

The winding means 3 is mounted to a pivot bar 22. The ends of the pivot bar 22 can slide along pivot holders 23 (in FIG. 2*a* to the right and left). The position of the ends of the pivot bar 22 is adjusted and controlled by a motorized pivot drive (not shown). The coil 21 can thereby be pivoted between different pivot positions (an alternative pivot position is shown in FIG. 2*d*). This corresponds to pivoting in (or opposite to) the direction of arrow 24 about a pivot axis S which extends perpendicularly to the plane of the drawing through the center of the coil 21.

The pivot holders 23 are rigidly mounted to an axial carriage 25. The axial carriage 25 may be moved along a straight, axial rail (not shown) in the direction A using a motorized axial drive (not shown). The axial rail is mounted to a Z carriage (not shown) which can be moved in the direction T, perpendicularly to the plane of the drawing, by a translation drive.

In the embodiment of FIG. 2*a*, the winding means 3 is consequently linearly moved together with the pivot drive by the axial drive. The pivot motion 24 is performed relative to the axial carriage 25.

The guiding means 7*a*-7*d* guide the band-shaped conductors or the conductor stack 8 exclusively in a straight line. During one rotation of the coil 21 about the winding axis W, the axial carriage 25 is moved by a conductor width BR (which is at the same time the width of a stack 8 of band conductors), wherein the value BR already includes twice the thickness of the insulation, such that the stack 8 of band-shaped conductors is also not bent through the short side of the band conductor between the guiding means 7*d* and the coil 21. The direction B in which the stack 8 is guided to the coil 21 remains the same. The possible travelling distance of the axis carriage 25 is sufficiently long to also guide the end areas of the coil 21 to the arriving stack 8.

Figure 2B:
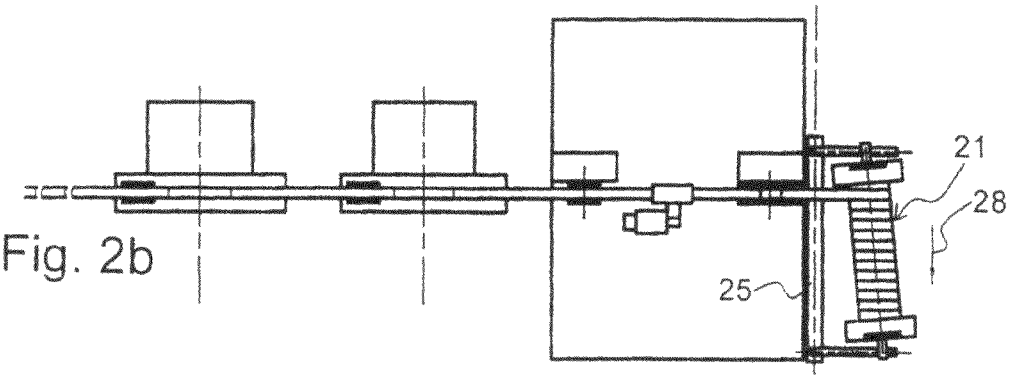
FIG. 2*b* shows the winding machine of FIG. 2*a* after displacement of the axial carriage.
Figure 2C:
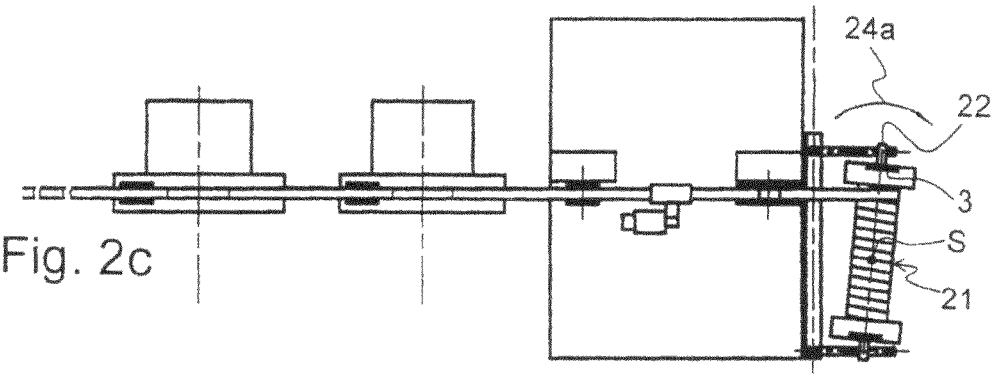
FIG. 2*c* shows the winding machine of FIG. 2*b* after pivoting the winding means.
Figure 2D:
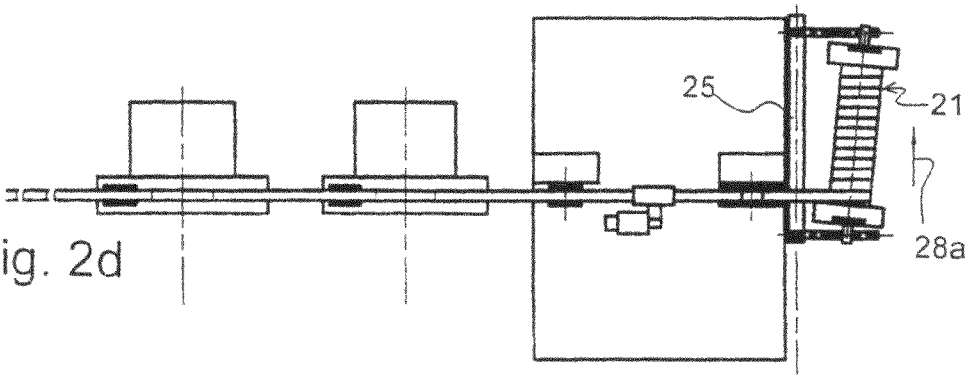
FIG. 2*d* shows the winding machine of FIG. 2*c* after further displacement of the axial carriage.

FIGS. 2*b* to 2*d* illustrate the winding sequence of subsequent layers in the winding machine 1 of FIG. 2*a*. Starting from the position of FIG. 2*a*, the just started layer is wound by turning the coil 21 about its winding axis W, and synchronously moving the axial carriages 25 along the direction of arrow 28. In FIG. 2*b*, this layer is finished. The coil 21 must then be prepared for the next layer. Towards this end, the coil 21 (or the winding device 3 with pivot rod 22) is pivoted about the pivot axis S in the direction of arrow 24*a* (compare FIG. 2*c*). The next layer can then be wound. Towards this end, the coil 21 is turned again about the winding axis W, and the axial carriage 25 including the coil 21 are synchronously displaced in the direction of arrow 28*a* (compare FIG. 2*d*). After pivoting in the direction of arrow 24, the next layer can be started (see FIG. 2*a*).

Figure 2E:
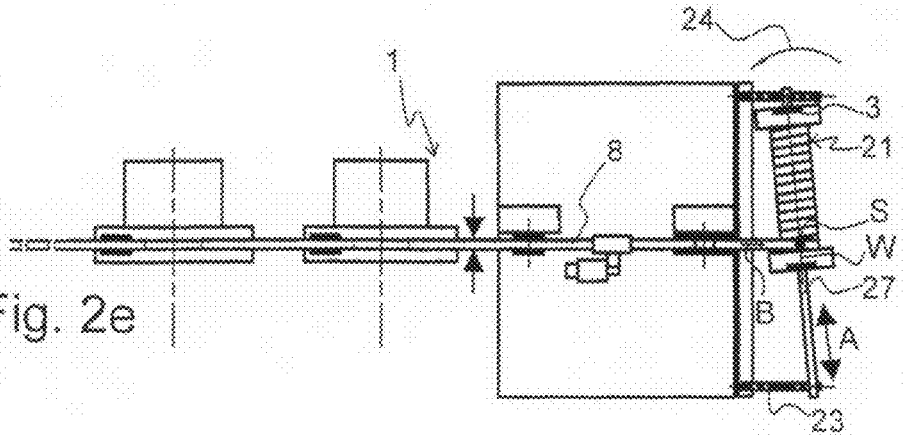
FIG. 2*e* shows an embodiment of an inventive winding machine, wherein the winding means can be displaced on a pivotable rail.

In the slightly modified embodiment of the winding machine 1 of FIG. 2*e*, the winding means 3, in which the coil 21 is held and can be turned through a winding drive, is disposed on a straight, pivotable rail 27. The winding means 3 can be moved along the pivotable rail 27 in the direction A. Direction A extends parallel to the winding axis W about which the coil 21 can be turned.

The ends of the pivotable rail 27 can, in turn, slide along pivot holders 23. The position of the ends of the pivotable rail 27 are controlled by a pivot drive (not shown). The coil 21 can thereby again be pivoted about the pivot axis S, wherein the pivot axis S is perpendicular to the plane of the drawing, and extends through the center of the pivotable rail 27. This means that the direction A changes during pivoting. The pivot axis S is stationary in this case. The position of the pivot axis S relative to the coil 21 depends on its axial displacement position along the pivotable rail 27. The pivot holders 23 are mounted to a Z-carriage which can be moved (not shown) perpendicularly to the plane of the drawing by means of the translation drive.

In the embodiment of FIG. 2*e*, the pivot drive pivots the winding means 3 together with the axial drive. The axial motion of the winding means 3 in the direction A is relative to the pivot drive.

Figure 3:
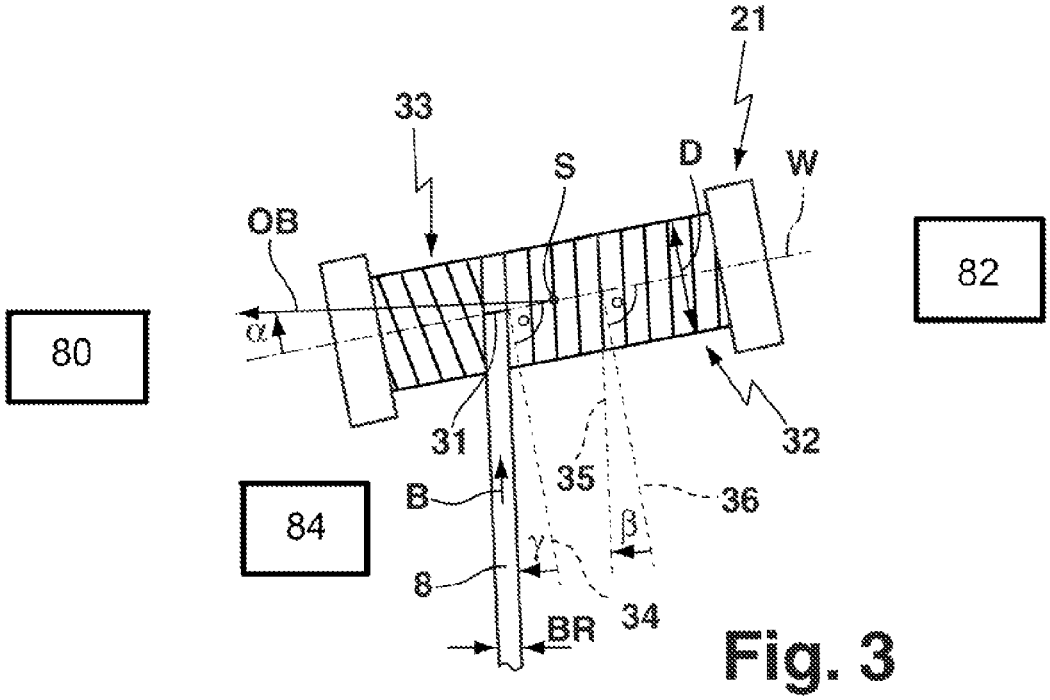
FIG. 3 shows a schematic view of a coil onto which a band-shaped conductor is wound in accordance with the invention.

During one rotation of the coil 21 about the winding axis W, the winding means 3 moves along the pivotable rail 27 by a slightly larger distance than one conductor width BR, namely by BR/cos(β), with β: pitch angle (see FIG. 3).

Figure 2F:
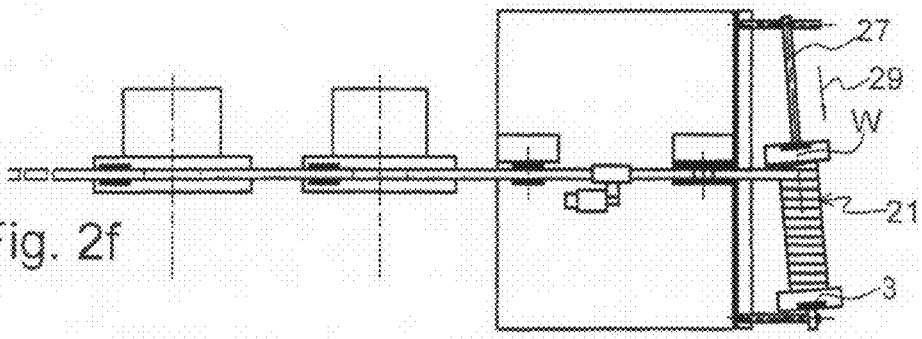
FIG. 2*f* shows the winding machine of FIG. 2*e* after displacement of the winding means along a pivotable rail.
Figure 2G:
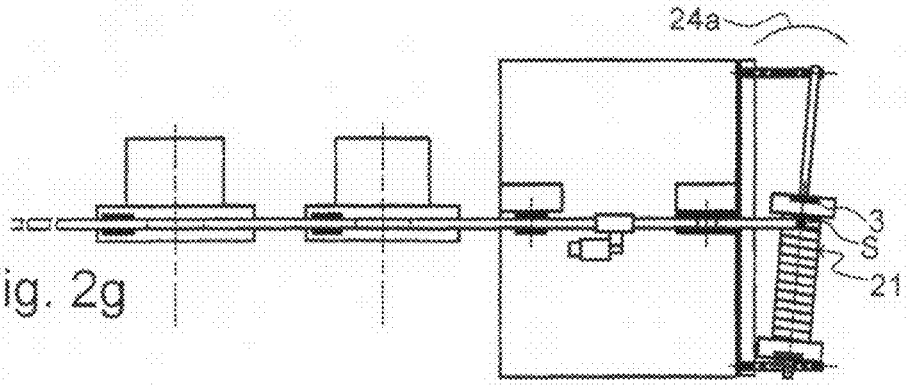
FIG. 2*g* shows the winding machine of FIG. 2*f* after pivoting the winding means.
Figure 2H:
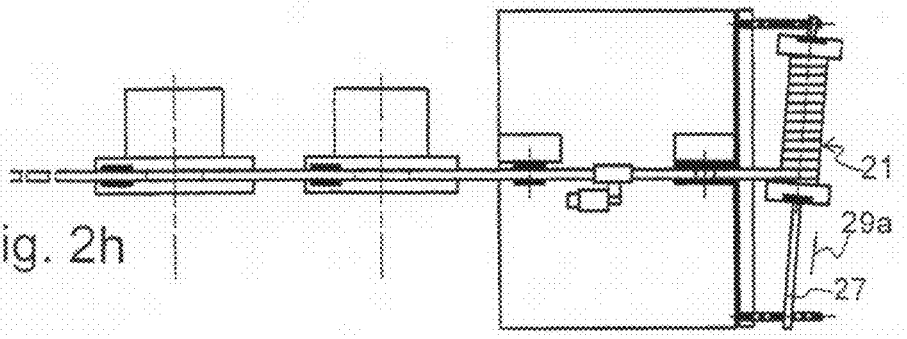
FIG. 2*h* shows the winding machine of FIG. 2*g* after further displacement of the winding means along the pivotable rail.

FIGS. 2*f* through 2*h* show, in turn, the winding sequence of successive layers in the winding machine 1 of FIG. 2*e*. Starting from the position of FIG. 2*e*, the just started layer is wound by turning the coil 21 about its winding axis W and moving the winding means 3 or the coil 21 synchronously along the direction of arrow 29 on the pivotable rail 27. In FIG. 2*f*, the layer is finished. The coil 21 must then be prepared for the next layer. Towards this end, the coil 21 or the winding means 3 is pivoted about the pivot axis S in the direction of arrow 24*a* (compare FIG. 2*g*). The next layer can then be wound. Towards this end, the coil 21 is turned again about the winding axis W and the coil 21 is synchronously displaced in the direction of arrow 29*a* (compare FIG. 2*h*). After pivoting in the direction of arrow 24, the next layer can be started (FIG. 2*e*) again.

FIG. 3 schematically shows in more detail the geometric relationships on the coil, e.g. the coil of FIG. 2*a* in a more advanced winding state of the layer.

A conductor stack 8 or in accordance with the invention, one single band-shaped conductor) is wound onto a coil 21. The stack 8 is thereby supplied to the coil 21 in a direction B. The stack 8 thereby extends in a tangential plane E parallel to the plane of the drawing (neglecting its thickness). The tangential plane E contains the contact line 31 of stack 8 and coil 21 and tangentially contacts the coil 21 or its uppermost layer 32.

The coil 21 has a central axis, i.e. the winding axis W, about which the coil 21 can be turned. The layer 32 is just being wound on the coil, which is supported on a layer disposed underneath.

The pitch angle β of the layer 32 just being wound and partially already wound is determined substantially by the actual diameter D of the coil 21 and the width BR of the stack 8 (or the identical width BR of the band-shaped conductors forming the stack 8) including twice the thickness of insulation. D depends on the number of wound layers underneath. The pitch within one winding must be one width BR (corresponding to one turning of the coil). For tight winding $\beta=\arctan[BR/(\tau D)]$. For large coil diameters D compared to the height HS of a conductor stack 8 and a small overall number of layers, the height of already wound layers can be neglected. The pitch angle β can be read as the angle between the direction 35 of extension of the stack 8 and the peripheral direction 36 of the coil at that place, at any location on the layer 32.

The coil 21 can be pivoted about the pivot axis S, which extends perpendicularly to the winding axis W and also perpendicularly to the direction B. The pivot angle α of the coil 21 is measured between the winding axis W and the direction OB. The direction OB extends parallel to the tangential plane E and perpendicularly to the direction B. In FIG. 2*a*, the direction OB is also parallel to direction A, in which the coil 21 can be moved by the axial drive.

The intake angle γ of the stack B is measured between the direction B and the peripheral direction 34 of the coil 21 in the area of the contact line 31. α=γ, since the direction OB is defined as being perpendicular to the direction B, and the peripheral direction 34 is perpendicular to the winding axis W.

In accordance with the invention, the coil 21 is wound in one orientation in which the pivot angle α of the coil 21 corresponds at any time to the desired pitch angle β, i.e. α=β. Consequently, the band-shaped conductors of the stack 8 are not bent through the short side during winding of the stack 8 (or of an individual band-shaped conductor) onto the coil 21.

Stationary guiding means generally determine the direction B, such that the direction B and the overall conductor intake are also fixed. The illustrated pivot position of the coil 21 is suited for winding the layer 32, but the pivot position is not suited for winding the layer 33. For winding the layer 33, the coil 21 can be turned in accordance with the invention through an angle of approximately 2β in a clockwise direction (to be more precise, the pitch angles β of successive layers differ slightly due to the larger diameter D in the radially outer layer and the coil 21 is rotated in accordance with the total amount of the respective pitch angles β of the two layers concerned). Pivoting of the coil 21 for changing the layers is also called a turning manoeuvre. In accordance with the invention, pivoting about the pivot axis S is performed slowly and synchronously with a turning motion of the coil 21 about the winding axis W in order to distribute the bending motion of the band-shaped conductors in the stack 8 through the short side over e.g. one winding, thereby minimizing the material strain.

Conventional winding machines cannot be pivoted about S. As a compromise for reciprocating layers, the band-shaped conductor is guided perpendicularly relative to the winding axis to the coil (intake angle=pivot angle=0°), wherein a certain amount of bending of the band-shaped conductor over the short side is accepted in the contact area during winding, corresponding to the pitch angle. This could damage the band-shaped conductor.

It should be noted that the angles α, β, γ in the figures are shown in an excessively large scale for clear illustration. In practice, the angles may e.g. be only a few tenth of a degree. As also schematically shown in FIG. 3, an axial drive 82 is structured for moving the coil core in a first direction which extends approximately parallel to the winding axis W. A pivot drive 80 rotates the coil core about a pivot axis S. The winding machine supplies the band-shaped conductor to the coil in a direction B and an additional pivot drive 84 turns the coil core about an additional pivot axis extending parallel to the direction B.

Figure 4:
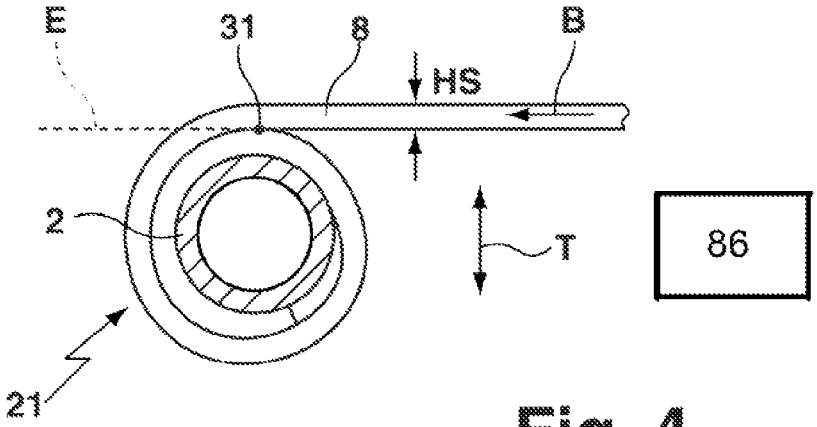
FIG. 4 shows a schematic cross-sectional view of a coil onto which a band-shaped conductor is wound in accordance with the invention.

FIG. 4 shows a schematic cross-section through the coil 21 of FIG. 3. The coil 21 comprises a hollow, circular cylindrical coil core 2 onto which the conductor stack 8 is wound. The stack 8 contacts the coil 21 at the contact line 31. The contact line 31 penetrates the plane of the drawing and is therefore only shown as a point. The tangential plane E extends parallel to the direction B and contains the contact line 31.

The coil core 2 and thereby the entire coil 21 can be moved in the direction T by means of a translation drive 86 to account for adjustment to the changing actual coil diameter during advanced winding.

Figure 5A:
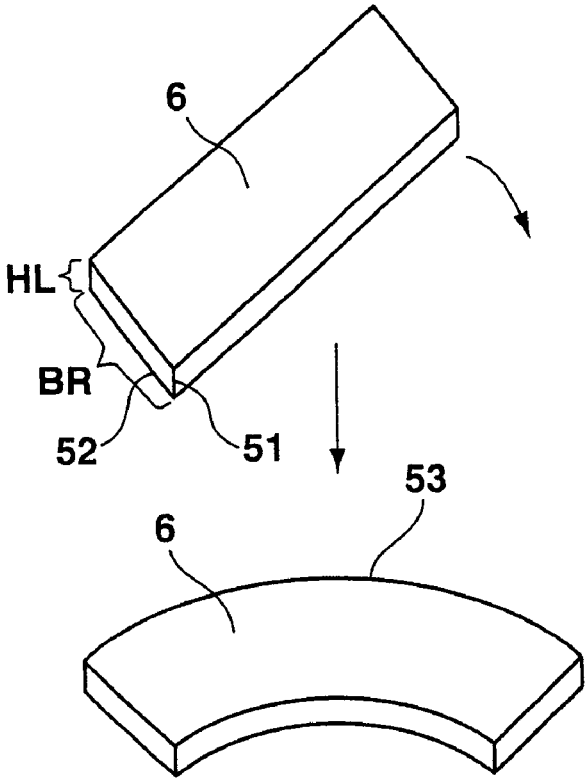
FIG. 5*a* shows a schematic view of bending a band-shaped conductor through the short side.
Figure 5B:
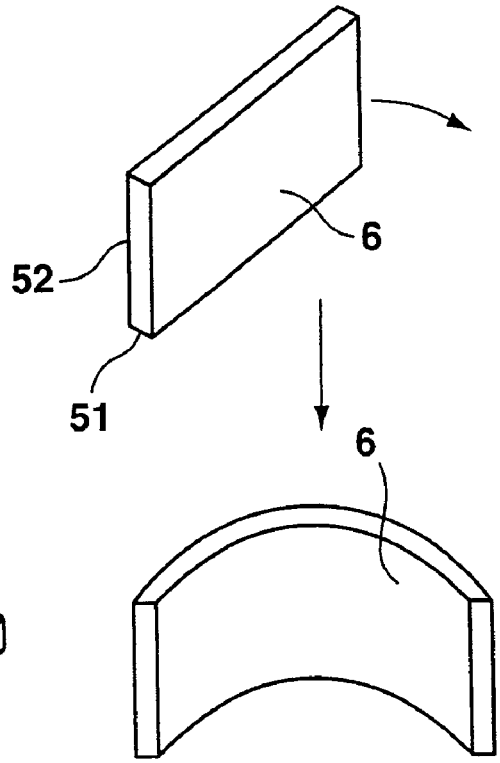
FIG. 5*b* shows a schematic view of bending a band-shaped conductor through the long side.

FIGS. 5*a* and 5*b* illustrate the potential mechanical stress of a band-shaped conductor 6.

A band-shaped conductor 6 has a short side 51 and a long side 52, as viewed in cross-section. The length of the short side 51 is designated as height HL of the band-shaped conductor. The length of the long side 52 is designated as the width BR of the band-shaped conductor. The band-shaped conductor 6 has no insulation in either case.

The band-shaped conductor 6 is bent through the short side by holding the front end of the band-shaped conductor 6 and moving the free end parallel to the long side 52 (FIG. 5*a* top). This bend (FIG. 5*a* bottom) is extremely detrimental to the band-shaped conductor 6. Radii of curvature of the outer edge 53 of less than 1 m are generally not tolerable for typical band-shaped conductors that contain brittle, ceramic superconducting material. In particular, the current carrying capacity that can be technically utilized is considerably reduced.

When, in contrast thereto, the free end is moved parallel to the short side (FIG. 5*b* top), the band-shaped conductor 6 is bent through the long side (FIG. 5*b* bottom). Such a mechanical stress can, in general, be better tolerated by the band-shaped conductor.

Figure 6:
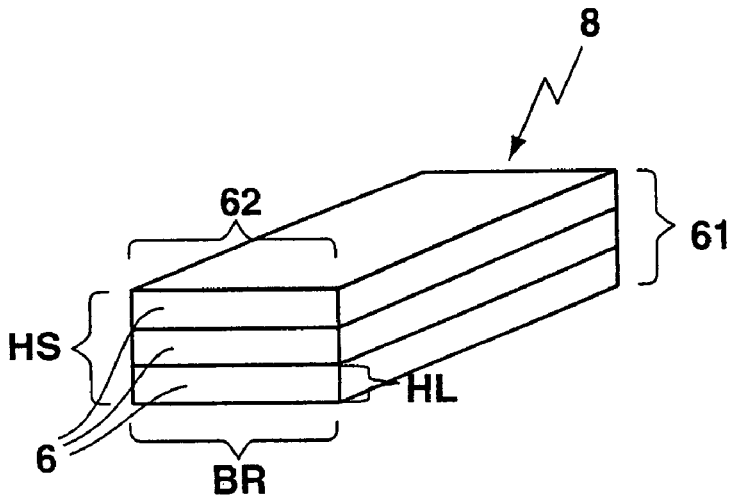
FIG. 6 shows a stack of band-shaped conductors for use in accordance with the invention.

FIG. 6 shows a stack or strand 8 of band-shaped conductors 6 which can be used within the scope of the invention. The illustrated stack 8 has no insulation. In this example, the stack 8 has a width BR which corresponds to the width BR of the band-shaped conductors 6 that form the stack 8. The stack 8 has also a height HS that corresponds to the product of the number of stacked band conductors 6 and the height HL of a band conductor 6. The stack 8 should not be bent through its short side 61 or the short sides of the band-shaped conductors 6 either, whereas bending over the long side 62 or the long sides of the band-shaped conductors 6 is relatively uncritical.

Figure 7A:
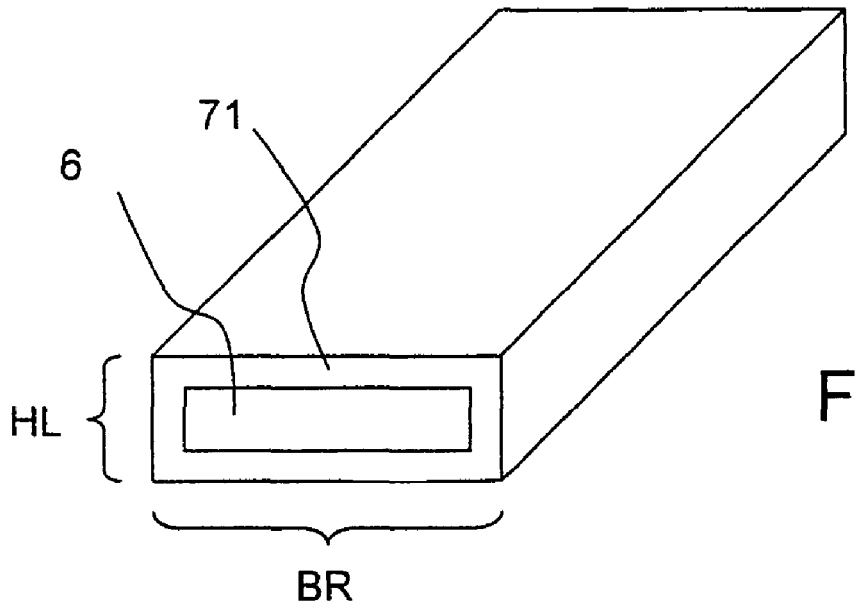
FIG. 7*a* shows a schematic view of a band-shaped conductor with insulation, which can be used in the present invention.

FIG. 7*a* shows a band-shaped conductor 6 which is surrounded by an insulation 71. For the purpose of this invention, the height HL of the band conductor 6 is then measured including insulation 71 in this invention, such that the height HL contains the wire thickness and twice the thickness of the insulation 71. Twice the thickness of the insulation 71 is thereby also analogously included in the width BR of the band-shaped conductor 6.

When the insulation consists of overlapping layers of an insulating tape, the thickness of insulation on one side of the band-shaped conductor 6 is obtained from the product of the insulating tape thickness and the number of layers of the insulating tape lying on top of each other.

Figure 7B:
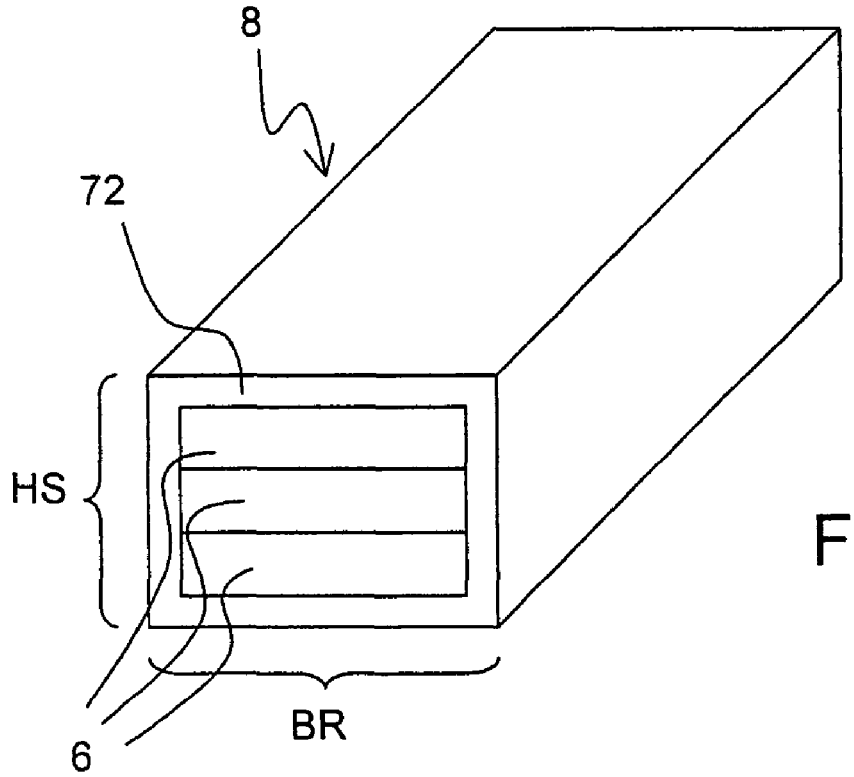
FIG. 7*b* shows a schematic view of a stack of band-shaped conductors, which can be used in the present invention.

FIG. 7*b* shows a stack 8 of band-shaped conductors 6, which is surrounded by a common insulation 72 for the whole stack 8. For the purpose of the invention, the stack height HS is then obtained from the wire thicknesses of the individual band-shaped conductors 6 and twice the thickness of the insulation 72. The dimension of the band-shaped conductors 6 and twice the thickness of insulation 72 are analogously included in the width BR of the stack 8.

The insulation 72 can, in turn, consist of partially overlapping layers of an insulating tape.

The invention claimed is:

1. A winding machine for winding a solenoid-shaped coil with a band-shaped conductor by manipulating a circular-cylindrical coil core on which the coil is wound, the machine comprising:

a winding drive for rotating the coil core about a winding axis W;

an axial drive for moving the coil core in a first direction A, said first direction extending approximately parallel to said winding axis W;

a pivot drive for rotating the coil core about a pivot axis S which extends perpendicular to said first direction A, wherein the winding machine is structured to execute all winding functions in reverse order by pressing a button; and a translation drive for moving the coil core in a second direction T, said second direction T extending perpendicularly to said first direction A and parallel to said pivot axis S.

2. The winding machine of claim 1, wherein the winding machine supplies the band-shaped conductor to the coil in a direction B and further comprising an additional pivot drive for turning the coil core about an additional pivot axis Z extending parallel to said direction B.

3. The winding machine of claim 2, further comprising at least one unwinding means holding a supply coil for the band-shaped conductor.

4. The winding machine of claim 3, further comprising guiding means, or guiding rails for transferring the band-shaped conductor from said supply coil of said at least one unwinding means to the coil.

5. The winding machine of claim 4, wherein said guiding means are stationary relative to the winding machine, said guiding means being structured such that the band-shaped conductor is not bent, or is only slightly bent through a short side thereof in a region extending from said supply coil to said guiding means such that a radius of curvature of the band-shaped conductor through the short side at an outer side of the band-shaped conductor is larger than or equal to 1 m.

6. The winding machine of claim 4, wherein said guiding means, or said unwinding means, have a conductor drive for supplying the band-shaped conductor from said supply coil of the at least one unwinding means via said guiding means to the coil, wherein said conductor drive is operated independently of said winding drive.

7. The winding machine of claim 6, wherein said conductor drive comprises a crawler drive.

8. The winding machine of claim 4, further comprising a control means for automatically adjusting a position of the coil core; wherein said position of the coil core is based on one of: a pivot angle $\alpha$ of said pivot axis S, a position in said direction A, a position in said direction T, or an angle of rotation of said additional pivot axis Z during winding of coil; wherein a band-shaped conductor to be transferred to said coil core is not bent, or is only minimally bent, through a short side thereof in a region extending from said guiding means to the coil such that a radius of curvature of the band-shaped conductor through the short side thereof at an outer side of the band-shaped conductor is larger than or equal 1 m.

9. The winding machine of claim 4, wherein several said unwinding means and said guiding means are provided for stacking several band conductors from several unwinding means and for commonly guiding them to the coil.

10. The winding machine of claim 9, wherein each said unwinding means has one single individually regulated tensile force controller.

11. The winding machine of claim 1, further comprising an insulation station for winding the band-shaped conductor or a stacked band conductor together with an insulation material.

12. The winding machine of claim 11, wherein said insulation station is structured for turning about an axis D, said axis D extending perpendicularly to a direction of motion F of the band-shaped conductor or the stack of band conductors.

13. The winding machine of claim 1, further comprising an intake measuring means for monitoring conductor intake using non-contact distance measurement.

14. The winding machine of claim 1, wherein the winding machine is designed to separately stop said axial drive.

15. The winding machine of claim 1, wherein said axial drive moves said coil core together with said pivot drive and further comprising an axial rail along which an axial carriage can be displaced by said axial drive, said coil core being mounted to said axial carriage together with said pivot drive.

16. The winding machine of claim 1, wherein said pivot drive pivots said coil core together with said axial drive and further comprising a rail disposed for pivoting by said pivot drive and along which said coil core is moved by said axial drive.

* * * * *